US011266868B2

(12) United States Patent
Ronan

(10) Patent No.: US 11,266,868 B2
(45) Date of Patent: Mar. 8, 2022

(54) MUSCLE STIMULATION DEVICE

(71) Applicant: John Ronan, Buffalo, NY (US)

(72) Inventor: John Ronan, Buffalo, NY (US)

( * ) Notice: Subject to any disclaimer, the term of this patent is extended or adjusted under 35 U.S.C. 154(b) by 82 days.

(21) Appl. No.: 16/560,834

(22) Filed: Sep. 4, 2019

(65) Prior Publication Data

US 2020/0069991 A1 Mar. 5, 2020

Related U.S. Application Data

(60) Provisional application No. 62/726,535, filed on Sep. 4, 2018.

(51) Int. Cl.
*A63B 21/065* (2006.01)
*A63B 23/035* (2006.01)
(Continued)

(52) U.S. Cl.
CPC ..... *A63B 21/065* (2013.01); *A61H 23/02* (2013.01); *A63B 23/02* (2013.01);
(Continued)

(58) Field of Classification Search
CPC ..... A61F 5/0003; A61H 23/0263; A61H 23/0218; A61H 23/02; A61H 2201/164; A61H 2201/1445; A61H 2201/5061; A61H 2201/5097; A61H 2201/1628; A61H 2201/501; A61H 2201/1623; A61H 2205/088; A61H 2201/5084; A61H 2201/165; A61H 2023/002; A61H 2201/1215; A61H 2205/065; A61H 2201/5023; A61H 2201/1638; A61H 2205/10; A61H 2205/06; A61H 2205/062; A61H 2205/08; A61H 2201/0192; A61H 2201/5025; A63B 21/065; A63B 23/03508; A63B 23/03533; A63B 23/0355; A63B 23/04; A63B 24/0087; A63B 23/02; A63B 2213/00; A63B 21/00069; A63B 21/4021; A63B 21/4019; A63B 21/4017;
(Continued)

(56) References Cited

U.S. PATENT DOCUMENTS 3,269,728 A * 8/1966 Blough ..... A63B 71/148 473/62
4,732,140 A * 3/1988 Stoffregen ..... A61H 23/00 601/71

(Continued)

*Primary Examiner* — Garrett K Atkinson
(74) *Attorney, Agent, or Firm* — Vincent G. LoTempio

(57) ABSTRACT

A vibration apparatus and an associated motor assembly attached to a glove or wrap for a body part to stimulate muscle activity in the area of application. The apparatus is capable of generating vibrations of various amplitudes at the same frequency or within a defined frequency range. The device causes vibration in a limb to which it is attached, such that muscle that are not normally utilized in a single range of motion activity are activated. The mechanism creating the vibration may an eccentric rotating mass vibration motor assembly attached to a glove or wrist support. Use of the device with fitness equipment provides an individual with the benefits associated with vibrational motion such as increased muscle use with a single exercise motion and increased muscle memory during use with sports activities.

7 Claims, 10 Drawing Sheets

(51) Int. Cl.

| | |
|---|---|
| ***A63B 23/04*** | (2006.01) |
| ***A63B 24/00*** | (2006.01) |
| ***A61H 23/02*** | (2006.01) |
| ***A63B 23/02*** | (2006.01) |
| ***A61H 23/00*** | (2006.01) |

(52) U.S. Cl.
CPC .... *A63B 23/0355* (2013.01); *A63B 23/03508* (2013.01); *A63B 23/03533* (2013.01); *A63B 23/04* (2013.01); *A63B 24/0087* (2013.01); *A61H 2023/002* (2013.01); *A61H 2201/165* (2013.01); *A63B 2213/00* (2013.01)

(58) Field of Classification Search
CPC ... A63B 2220/64; A63B 21/22; A63B 71/141; A63B 71/14; A63B 2243/0025; A63B 2209/00; A63B 2244/10; A63B 2071/0655; A63B 2102/18; A63B 2209/10; A63B 2244/09; A63B 2243/0037; A63B 2071/0081; A63B 2244/102
See application file for complete search history.

(56) References Cited

U.S. PATENT DOCUMENTS 4,905,321 A * 3/1990 Walunga ..... A41D 19/01582 2/160
5,014,981 A * 5/1991 Prelich ..... A63B 21/00192 482/106
5,334,131 A * 8/1994 Omandam ..... A61H 23/0263 601/70
5,361,241 A * 11/1994 Ferrara ..... G04B 25/04 368/230
5,540,735 A * 7/1996 Wingrove ..... A61F 5/0118 602/21
5,575,761 A * 11/1996 Hajianpour ..... A61H 23/0263 601/48
5,766,236 A * 6/1998 Detty ..... A61N 1/321 602/2
5,902,256 A * 5/1999 Benaron ..... A61H 23/0263 601/15
6,093,164 A * 7/2000 Davis ..... A61H 23/0263 601/46
6,374,283 B1 4/2002 Chessell et al.
6,645,128 B1 * 11/2003 Hur ..... A63B 21/0004 482/105
6,748,604 B2 * 6/2004 Duboff ..... A41D 19/0024 2/160
6,852,067 B2 * 2/2005 Limonadi ..... A61B 5/1125 400/704
6,866,644 B1 * 3/2005 Kost ..... A61H 23/02 601/49
7,402,144 B2 * 7/2008 McLeod ..... A61H 1/001 601/27
7,462,158 B2 * 12/2008 Mor ..... A61H 23/0218 482/148
7,955,282 B2 * 6/2011 Doo ..... A61H 23/0245 601/2
8,012,107 B2 9/2011 Einav
9,757,266 B2 * 9/2017 Hoffman ..... A61N 1/36031
10,071,015 B2 * 9/2018 Seo ..... A61H 23/0218
10,172,762 B1 * 1/2019 Branch ..... A61H 23/02
10,758,396 B2 * 9/2020 Rivlin ..... A61F 5/05866
10,843,330 B2 * 11/2020 Smith ..... F16D 65/18
2003/0013580 A1 * 1/2003 Limonadi ..... A61B 5/6825 482/45
2003/0028132 A1 * 2/2003 Bastia ..... A61H 23/0254 601/57
2004/0260211 A1 * 12/2004 Maalouf ..... A61H 23/02 601/15
2005/0131319 A1 * 6/2005 der Meer ..... A61H 1/005 601/49
2006/0287618 A1 * 12/2006 Miranda ..... A61H 23/02 601/46
2007/0255187 A1 * 11/2007 Branch ..... A61H 7/001 601/15
2008/0200850 A1 * 8/2008 Casalino ..... A61H 23/0245 601/54
2009/0005713 A1 * 1/2009 Podrazhansky .... A61H 23/0236 601/2
2009/0054980 A1 * 2/2009 Ludlow ..... A61H 23/0245 623/9
2009/0112134 A1 * 4/2009 Avni ..... A61H 23/0263 601/15
2009/0221943 A1 * 9/2009 Burbank ..... A61N 1/36021 601/46
2010/0318007 A1 * 12/2010 O'Brien ..... A61F 5/56 601/48
2011/0071482 A1 * 3/2011 Selevan ..... G04F 3/08 604/307
2012/0046579 A1 * 2/2012 Radi ..... A61H 11/00 601/46
2012/0059298 A1 * 3/2012 Hoffman ..... A61F 5/013 602/21
2012/0142416 A1 * 6/2012 Joutras ..... G06F 3/014 463/36
2013/0331236 A1 12/2013 Moss
2015/0309185 A1 * 10/2015 Chichester ..... G01T 7/00 250/362
2017/0106249 A1 * 4/2017 Marton ..... A63B 24/0087
2017/0216078 A1 * 8/2017 Rivlin ..... A61F 5/05866
2018/0236337 A1 * 8/2018 Frith, Jr. ..... A63B 21/0004
2019/0176320 A1 * 6/2019 Smith ..... F16D 55/00

* cited by examiner

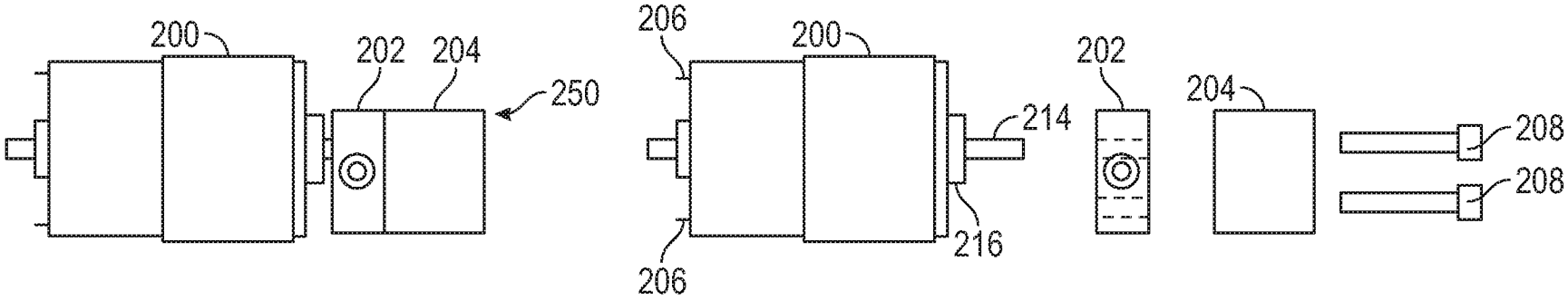
FIG. 10A
FIG. 10B
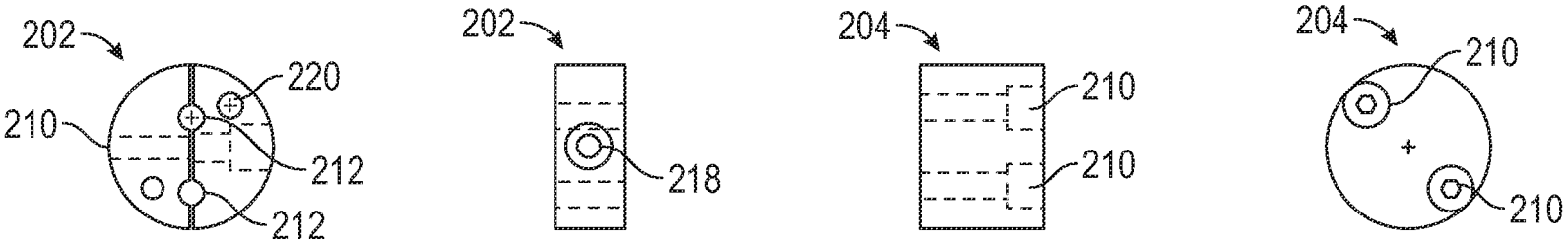
FIG. 10C
FIG. 10D
FIG. 10E
FIG. 10F

MUSCLE STIMULATION DEVICE

CROSS-REFERENCE TO RELATED APPLICATIONS

This application claims the benefit of U.S. Provisional Application No. 62/726,535, filed on Sep. 4, 2018.

FIELD

The present disclosure relates to a vibration apparatus and an associated motor assembly attached to a glove or wrap for a body part. In particular, the disclosure relates to an apparatus capable of generating vibrations of various amplitudes at the same frequency or within a defined frequency range. Additionally, the preferred embodiments of the present disclosure relate fitness devices that are designed to provide an individual with the benefits associated with vibrational motion such as increased muscle use with a single exercise motion and increased muscle memory during use with sports activities.

BACKGROUND

A means for communicating vibrations to a plate or platform, by use of a shaft rotationally driven by a motor and use of eccentric weights, is known in the art. Generally, all types of vibrational motor assemblies share the same basic structure; namely, a motor rotatably driving a shaft, at least one eccentric weight operably coupled to the rotating shaft, and a substantially rigid plate or platform. Furthermore, traditional applications for vibration plates or platforms include soil compacting, concrete laying, and therapeutic vibrational devices such as massagers and exercise equipment. Some devices utilize vibration (U.S. Pat. Nos. 5,575,761 and 5,857,984), but they are used for therapeutic treatments and are not included with a support wrap and used to vibrate a body limb during exercise or sporting activity involving that limb.

SUMMARY

The muscle stimulation device according to the present disclosure may be wrapped around a wrist or other body part to enhance muscle stimulation during exercise or sport activities. In one embodiment, the device may be wrapped around the wrist and/or hand for stimulating the stabilizer muscles and/or primary muscles during resistance exercises. More so, the hand wrapping device helps prevent injury to the knuckle, hand, and wrist areas by wrapping the knuckles inside a resilient wrap body or glove and passing the thumbs through at least one thumb strap to form a snug fit around the hands and wrists; and further including an integral vibrating motor that stimulates the stabilizer and primary muscles during resistance exercises.

BRIEF DESCRIPTION OF THE DRAWINGS

The disclosure will now be described, by way of example, with reference to the accompanying drawings, in which:

FIG. 9A shows a flat bench dumbbell fly resistance exercise, FIG. 9B shows a decline bench dumbbell press resistance exercise, FIG. 9C shows a barbell bench press resistance exercise, and FIG. 9D shows a seated overhead barbell press resistance exercise, in accordance with an embodiment of the present disclosure.

FIGS. 10 A-10F illustrate an eccentric rotating mass vibration motor and components thereof. FIG. 10A illustrates the eccentric rotating mass vibration motor assembly. FIG. 10B shows an exploded view of the eccentric rotating mass vibration motor assembly. FIG. 10C shows a cross sectional view of the eccentric mount. FIG. 10D shows a side view of the eccentric motor mount. FIG. 10 E shows a side view of the eccentric mass. FIG. 10. F shows a front view of the eccentric mass.

Like reference numerals refer to like parts throughout the various views of the drawings.

DETAILED DESCRIPTION

Figure 1:
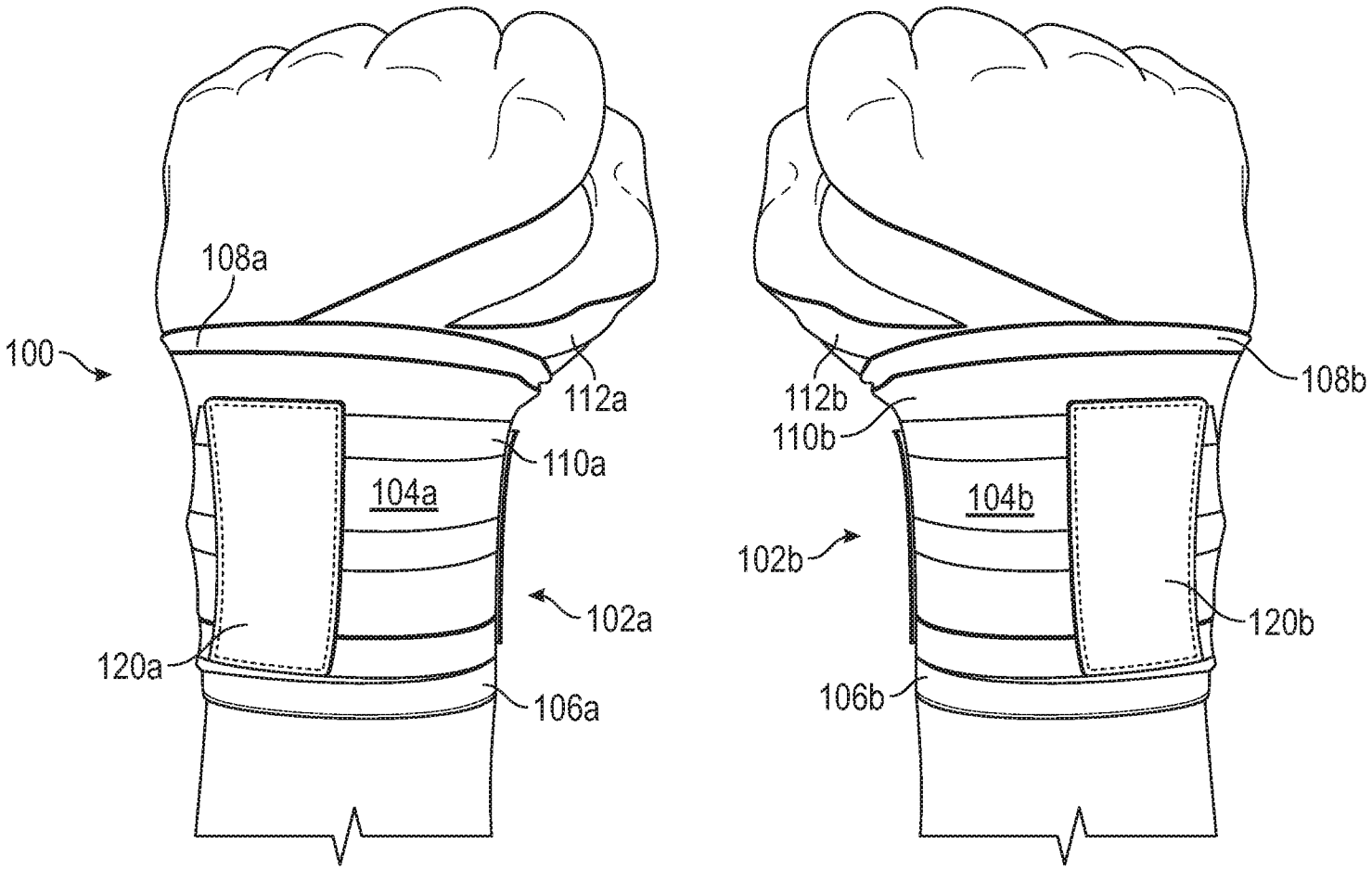
FIG. 1 illustrates a perspective view of an exemplary muscle stimulation wrist and/or hand wrapping device for stimulating the stabilizer muscles and/or primary muscles being donned on both hands, in accordance with an embodiment of the present disclosure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the disclosure as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this disclosure as required by 35 U.S.C. § 112.

In one embodiment of the present disclosure presented in FIGS. 1-10, a device 100 for muscle stimulation and method of stimulating the stabilizer muscles and/or primary muscles during resistance exercises is shown. In one embodiment, device 100 securely wraps around the forearms, hands, and wrists while simultaneously providing variable vibratory stimulations to the forearm/hand region during resistance exercises. Hand wrapping device 100, hereafter "device 100" helps prevent injury to the knuckle, hand, and wrist areas by wrapping the knuckles inside a resilient wrap body 102*a-b* and passing the thumbs through at least one thumb strap 112*a*, 112*b* to form a snug fit around the hands and wrists.

In one non-limiting embodiment, device 100 further includes a vibrating motor 120*a-b*, integral with the wrap body 102*a-b*. Vibrating motor 120*a-b* is disposed to press against the wrap body 102*a-b*. Vibrating motor 120*a-b* is also configured to vibrate at variable intensities, including optimal ranges of revolutions per minute (RPM) for an eccentric rotating mass vibration motor assembly 250 (as shown in FIGS. 10A-10F). Vibrating motor 120*a-b* causes the wrap body 102*a-b* to vibrate and stimulate the stabilizer muscles during resistance exercises.

This vibratory stimulation induces motion otherwise not created throughout the traditional resistance exercises. Thus, stabilizer muscles and/or primary muscles are utilized in novel ways in order to hold objects such as weights steady during lifting exercises. The vibratory intensity can be adjusted by the user through use of a dial or other switching means known in the art. The device 100 further comprises a power source 114 for the vibrating motor 120*a-b*, and an emergency power off switch 116 for instantly powering off the vibrating motor 120*a-b*.

One objective of the present disclosure is to provide a convenient yet supportive and protective limb, wrist and/or hand wrap which can be used in conjunction with weight lifting and other sports, including, but not limited to, basketball, baseball, football and other target-related sports where accuracy of directing or catching a ball is of importance. Throwing or shooting balls for accuracy can be improved by working the stabilizer muscles through the present disclosure. Lifting objects, such as dumbbells, can provide a user with an opportunity to work out more muscle groups, including stabilizer muscles, than a standard set of dumbbell lifts would cause.

Another objective is to stabilize joints while inducing vibratory motion in muscles.

Another objective is to stimulate the primary and or stabilizer muscles in the hand, shoulder and upper body area with an intensity-adjustable vibrating motor 120*a-b*.

Another objective is to provide a wrist and/or hand wrap that is primarily used in gym environments and/or therapeutic settings as an effective tool to strengthen the stabilizer muscles of the user.

Another objective is to maintain the alignment of the joints, and compresses and lends strength to the soft tissues of the hand during the impact of a punch.

Another objective is to prevent injury to the knuckle, hand, and wrist areas during boxing and martial arts related sports.

Another objective is to provide a padded insert 108*a*, 108*b* fitted inside the upper surface 104*a-b* of the wrap body 102*a-b* to align with the knuckles.

Another objective is to provide a padded insert 108*a-b* fabricated from a deformably resilient material, such as a gel, that pads the knuckles when punching a target.

Another objective is to provide thumb straps 112*a*, 112*b* that can be pulled to a desired tautness, so as to achieve a desired compression of the wrap body 102*a-b* around the hand.

Another objective is to provide strap fasteners that comfortably and detachably retain the wrap body 102*a-b* around the wrist.

Another objective is to provide a hand wrap better suited for the consumer involved in combative and recreational forms of boxing and martial arts which is more convenient and easier to use than the traditional long cloth hand wrap.

Another objective is to provide a hand wrap that is easy to don on the hands.

Another objective is to induce vibratory motion in limbs during sports or exercise activity.

Typically, a hand wrap is a strip of cloth used by boxers to protect the hand and wrist against injuries induced by punching. It is wrapped securely around the wrist, the palm, and the base of the thumb, where it serves to both maintain the alignment of the joints, and to compress and lend strength to the soft tissues of the hand during the impact of a punch.

Often, participants involved in boxing and martial arts-related sports, wear hand and wrist protection under larger boxing or bag gloves for additional protection and support. This protection is commonly called a hand wrap. Traditional hand wraps are made of cotton or canvas material, and are several feet in length. The participant will tightly wrap this material around his or her knuckles, hands, and wrists. Such hand wraps help prevent serious injury to hands during full contact professional or amateur fighting if they are administered and used correctly.

With regard to the present disclosure, the device 100 may be used for a variety of sports, including football, basketball, soccer, tennis and other sports where a target is involved. For example, use of the device 100 on a wrist or arm while shooting a basketball can improve muscle coordination and improve accuracy of the shot after practicing with the device. Similarly, use of the device on a wrist or arm while catching a football can improve the ability to catch once the device is removed. In a similar manner, placing device 100 on a leg during a soccer training session could improve accuracy and strength of the kick once the device 100 is removed.

In one embodiment, the vibration motor is disposed within the body wrap. The wrap may have multiple layers of fabric or material between which the vibration motor may be situated.

As referenced in FIG. 1, in one embodiment the device 100 comprises a resilient wrap body 102*a-b* sized and shaped to enclose the wrists and knuckles. Wrap body

102*a-b* is defined by a fabric material having an upper surface 104*a-b*, and a lower surface opposing the upper surface 104*a*, 104*b*. The upper and lower surfaces encapsulate a resilient wrap body cavity with a padded insert 108*a-b* disposed therein. Further, wrap body 102*a-b* may be defined by an upper end 110*a-b* and a lower end 106*a*, 106*b* opposing the upper end 110*a*, 110*b*. Wrap body 102*a-b* is sized and dimensioned to slidably receive the forearm, wrist, and knuckle.

In some embodiments, wrap body 102*a-b* is fabricated from a partially elastic material, i.e., fully elastic or semi-elastic material, e.g., natural rubber, cotton, spandex, or a combination. In one non-limiting embodiment, the padded insert 108*a-b* comprises a deformably resilient material. Though other materials and dimensions may be used.

In one embodiment, the present disclosure includes a wrap body 102*a-b* glove designed to prevent hyperextension of the ligaments and tendons of the wrists of persons engaged in weightlifting and other activities where sprains to the wrist can occur. That glove has a wrist strap that is attached to the glove body and wrapped around the wrist to secure the glove to the hand and bind the wrist so that hyperextension does not occur. The glove is attached to a vibration motor.

Figure 2:
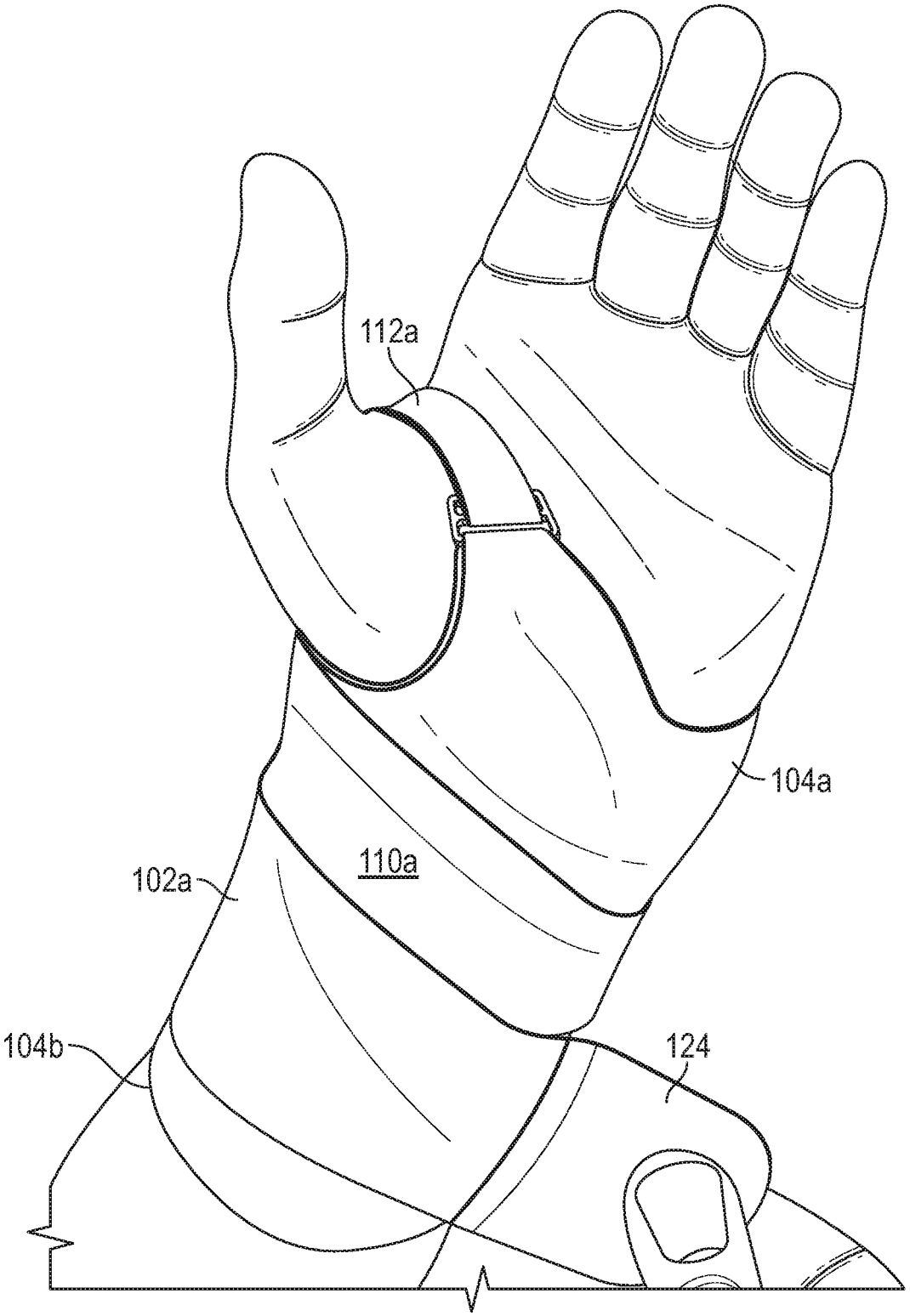
FIG. 2 illustrates a front perspective view of the muscle stimulation wrist and/or hand wrapping device shown in FIG. 1, in accordance with an embodiment of the present disclosure.

As FIG. 2 illustrates, device 100 further comprises at least one resilient thumb strap 112*a*, 112*b* that is directly coupled to upper end 110*a-b* of the wrap body 102*a-b*. Thumb strap 112*a*, 112*b* forms a loop that is sized and dimensioned to receive the thumb. Thumb strap 112*a-b* may be length adjustable to accommodate variously sized hands.

In one alternative embodiment, wrap body 102*a-b* further comprises a flap 124 to secure the wrap body 102*a-b* to the forearm. Upper surface 104*a*, 104*b* of wrap body 102*a-b* is operably configured to have a first position along flap translation path encapsulating the resilient wrap body 102*a-b* cavity and a second position along flap translation path defining a resilient wrap body 102*a-b* opening spatially coupled to the resilient wrap body 102*a-b* cavity to enable removal and entry of the padded insert 108*a-b*. In one embodiment, flap 124 is a hook-and-loop configuration that mates with a corresponding hook-and-loop on upper surface 104*a-b* of wrap body 102*a-b*.

Figure 3:
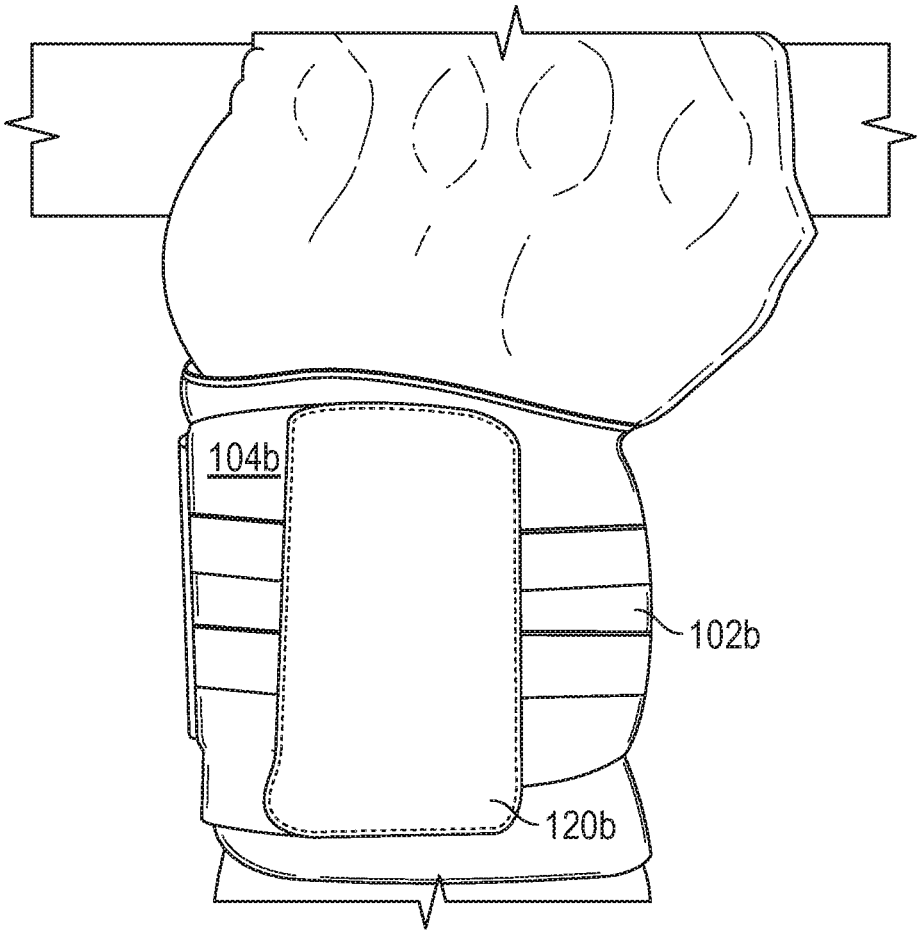
FIG. 3 illustrates a rear perspective view of the muscle stimulation wrist and/or hand wrapping device shown in FIG. 1, in accordance with an embodiment of the present disclosure.

In one embodiment, wrap body 102*a-b* comprises a wrapped position along a hand wrapping path with the wrap body 102*a-b* encapsulating the forearm and hand, the thumb strap 112*a*, 112*bs* wrapped around the thumbs, and the padded insert 108*a-b* aligned with the knuckles. This allows the user to securely fasten the wrap body 102*a-b* to the forearm, such that the vibrating motor 120*a-b*-through the wrap body 102*a-b*-vibrates against the forearm. For example, FIG. 2 illustrates a front perspective view of wrap body 102*a*, and FIG. 3 illustrates a rear perspective view of wrap body 102*b*.

Figure 4:
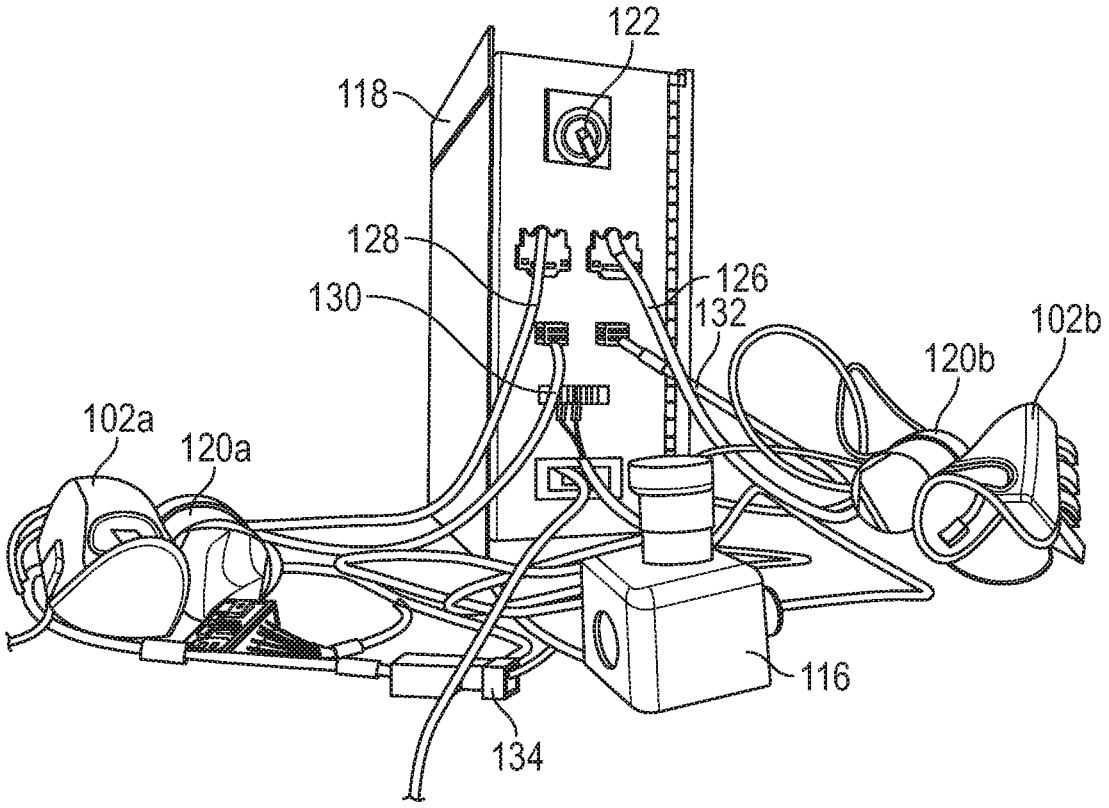
FIG. 4 illustrates a perspective view of an exemplary control module, wrist and/or hand wraps, vibrating motors, power off switch, emergency stop device, and power source, in accordance with an embodiment of the present disclosure.

Turning now to FIG. 4, device 100 also includes a vibrating motor 120*a-b*. Vibrating motor 120*a-b* is disposed against the wrap body 102*a-b*, or may be detachably coupled to wrap body 102*a-b*, or may be integral with wrap body 102*a-b*. To account for individual variations in strength, device 100 comes equipped with adjustable vibrating motor 120*a*, 120*b*. The vibrating motor 120*a-b* vibrating at variable vibratory intensities, whereby the vibrations stimulate the stabilizer muscles near the hands as well as stabilizer muscles of the upper body and shoulder and scapula (shoulder blades). In one non-limiting embodiment, a compact, yet powerful vibrating motor 120*a-b* is secured on the top of each wrist on the wrap body 102*a-b*. The vibrating motor 120*a-b* is configured to generate powerful vibrations.

Figure 5:
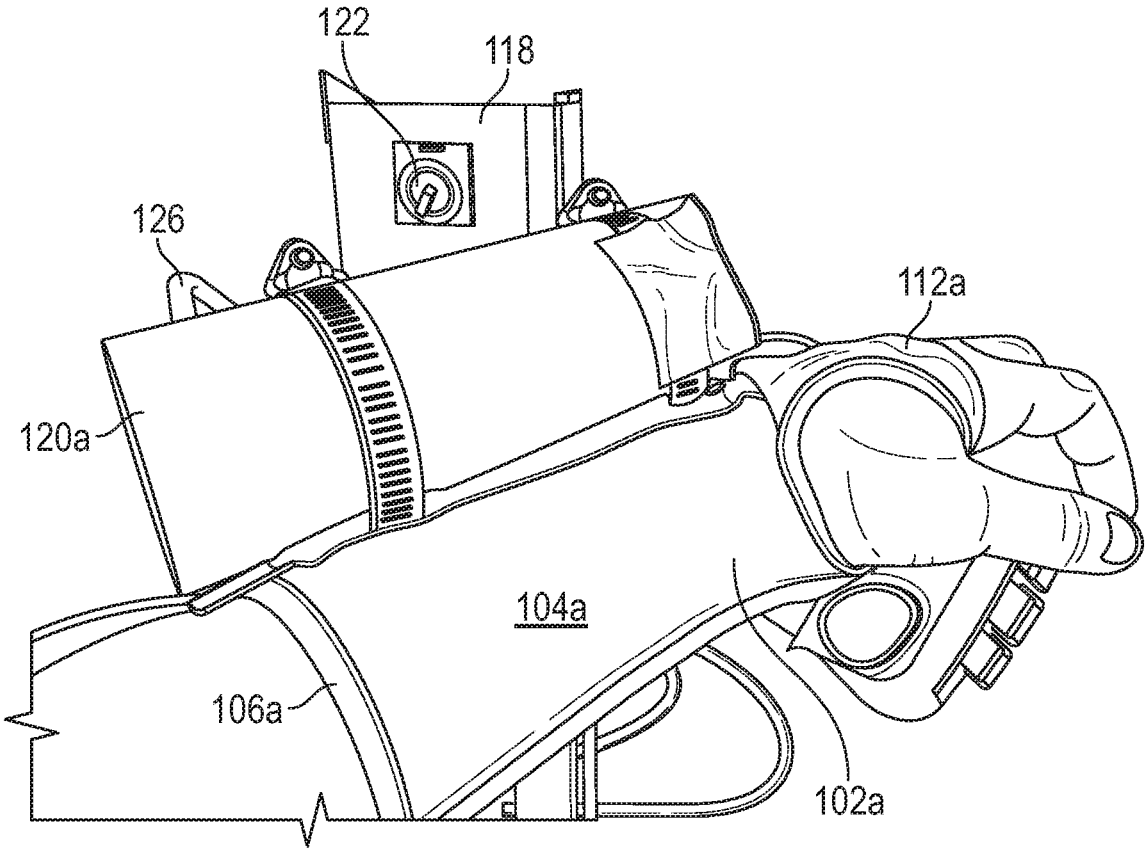
FIG. 5 illustrates a left-handed perspective view of the wrap body covering the hand and forearm, and a vibrating motor attached to the wrap body, in accordance with an embodiment of the present disclosure.
Figure 6:
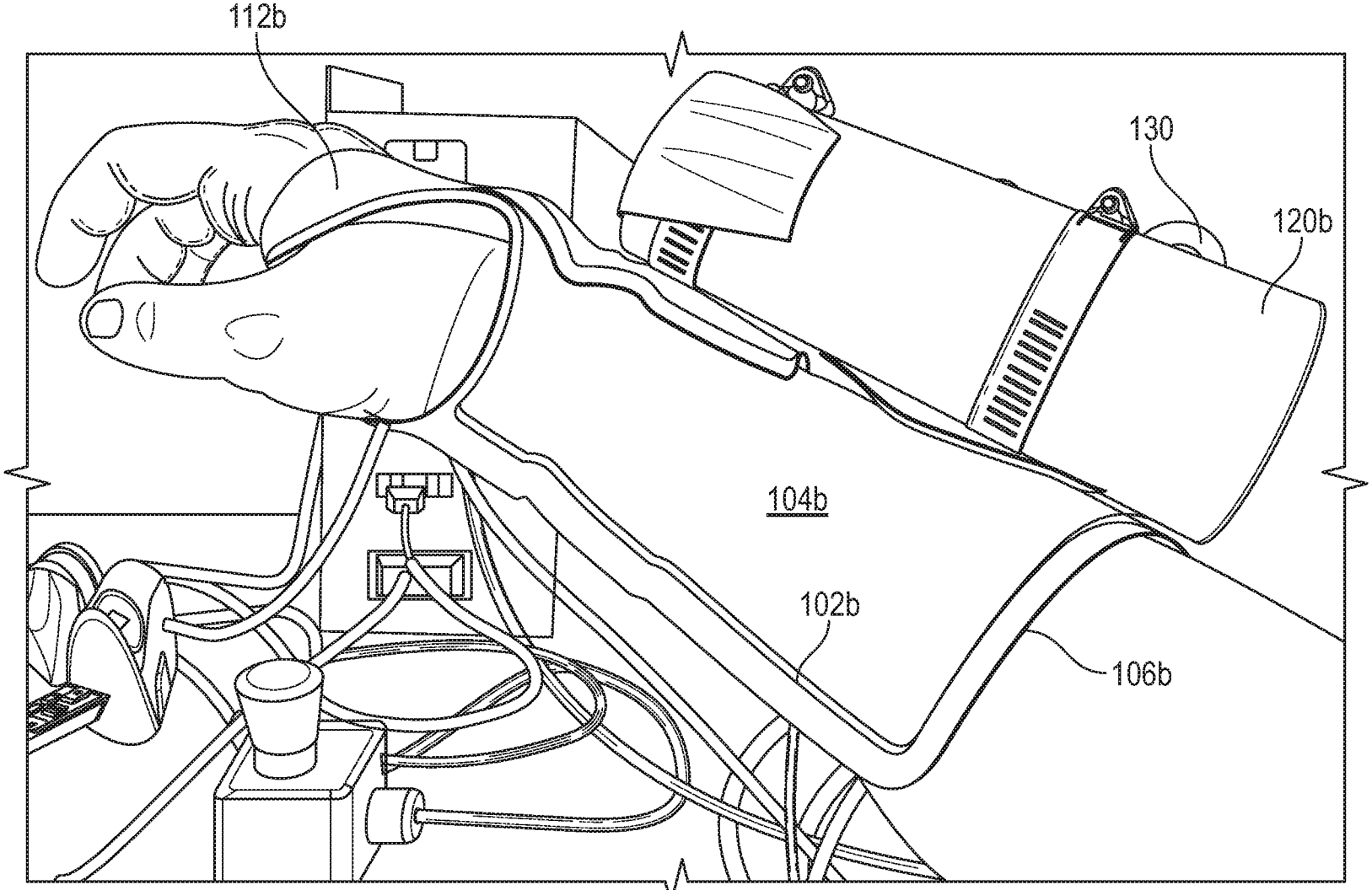
FIG. 6 illustrates a right-handed perspective view of the wrap body covering the hand and forearm, and a vibrating motor attached to the wrap body, in accordance with an embodiment of the present disclosure.

Vibrating motor 120*a*, 120*b* attaches directly to a corresponding wrap body 102*a-b*. For example, FIG. 5 illustrates a left-handed perspective view of wrap body 102*a* covering the hand and forearm, and a vibrating motor attached to wrap body 102*a*. FIG. 6 illustrates a right-handed perspective view of wrap body 102*b* covering the hand and forearm, and a vibrating motor attached to wrap body 102*b*. wrap body 102*b* has a vibrating motor attached just below the wrist on the arm. The vibrating motor 120*a-b*, 120*b* may have a housing within which a eccentric and standard motor is situated. The housing may have clamps or clasps encircling the housing and extending through a portion of the wrap body 102*a-b* to secure the vibrating motor to the arm just below the wrist. The vibrating motor 120*a-b* should not be situated above the wrist, such that the vibrating motor 102*a-b* would interfere with motion of the wrist or cause potential injury or damage to the wrist. Ideally, the vibrating motor 120-*a-b* would be situated at least 2 inches from the wrist in the direction of the elbow, preferably such that a mounting plate for the vibrating motor 120*a-b* is situated along the upper ⅔ of the forearm. From FIGS. 5 and 6, the proper placement of vibrating motor 120*a-b* may not be evident. However, it is to be understood that the vibrating motor 120-*a-b* should be situated at least 2 inches from the wrist in the direction of the elbow, preferably such that a mounting plate for the vibrating motor 120*a-b* is situated along the upper ⅔ of the forearm. In some embodiments, placement of the vibrating motor 120*a-b* may be closer to or further from the joint so as not to interfere with necessary movement or cause potential injury to the joint.

For example, the user is performing a bench press with 200 pounds, and the vibrating motor 120*a-b* generates vibrations powerful enough to require the user to steady the weight. Depending on the amount of the load, and the desired stimulation of the user, the vibration intensity can be adjusted accordingly. In one non limiting embodiment, the specification of vibrating motor 120*a-b* may include, without limitation: W (Watts): 50; A (Amps): 0.8; RPM (Rotations Per Minute): 3000; V (Volts): 220; Nm (Newton Meters): 0.2; and Ins. (Insulation): F In some embodiments, a switching mechanism 122 is used to regulate the vibratory intensity of the vibrating motor 120*a-b*. Switching mechanism 122 may include a dial (see FIG. 4). Though other intensity-regulating switches, dials, and buttons known in the art may be used. In one non-limiting embodiment, an adjustable dial provides simultaneous control over both motors but may come with two adjustable dials allow for control over each motor independently.

Looking again at FIG. 4, a control module 118 regulates the vibrating motor 120*a-b* and the switching mechanism 122. Control module 118 may include a tower with wiring, circuitry, and other known electrical components that enable operation of electrical components of device 100. Further, a power source 114 powers the vibrating motor 120*a-b*. The vibrating motor 120*a-b* may include a simple DC electric motor. The power source can include a battery, a power socket, a solar panel, an exterior electrical outlet, or any other power source known in the art.

Figure 7:
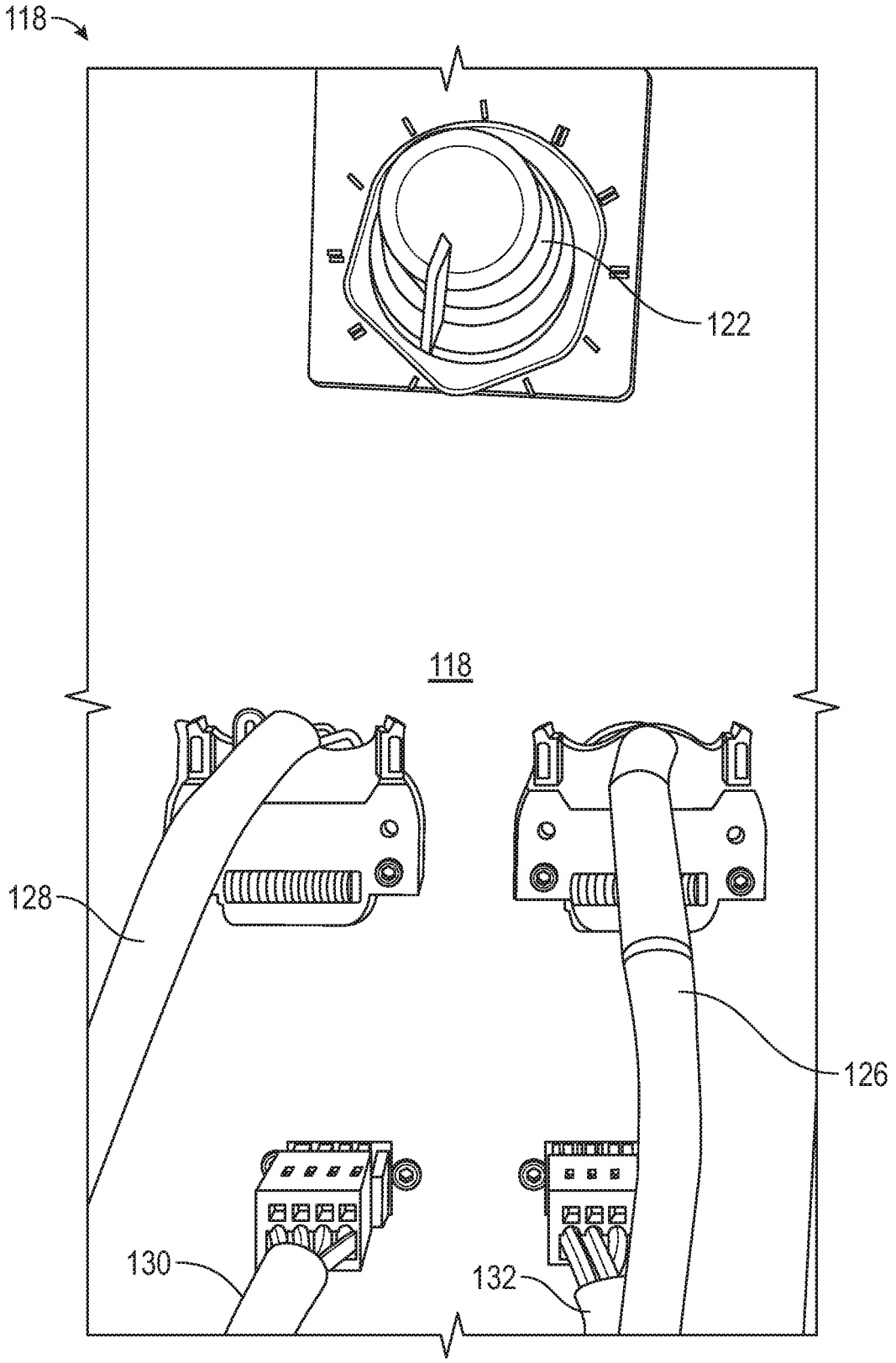
FIG. 7 illustrates a perspective view of an exemplary switching mechanisms and cables on a control module, in accordance with an embodiment of the present disclosure.

FIG. 7, shows one possible embodiment, in which reference 122 is the switching mechanism 122 (dial) to control speed (intensity of vibration). Thus, by adjusting the dial(s), the user may modify the magnitude of vibrations until the desired intensity is achieved. In another non-limiting embodiment, the adjustable dial that allows the user to modify the magnitude of vibrations to the desired intensity will be located on the underside of each wrist. The dial features three user-friendly settings with varying degrees of intensity: low, medium, and high intensity.

As FIG. 7 shows, below the switching mechanism 122, there are four cords 126, 128, 130, 132 leading away from the control module 118. They are a set of two cords 126, 128 with a black base above a set of two cords 130, 132 with a white base. One cord with a black base and one cord with a white base lead to each vibration motor 120*a-b*. Thus, there are two cords that connect to each motor, with four cords 126, 128, 130, 132 total for both motors 120*a-b*. In one embodiment shown in FIG. 4, an armature/power connector 134 is used. The armature/power cables are inducing the controls to turn the motors internal connections based on the settings of the switching mechanism 122, and the motor internally has a rotor/stator assembly.

The motor 120*a-b* is manufactured with two cables coming out of the motor housing, about 6" long and each one is terminated at a connector. The two black connectors and accompanying cables 126, 128 on the control box are for the encoder/feedback and the two white connectors with accompanying cables 130, 132 are for the armature/power connector 134. The two encoder/feedback cables 126, 128 are approximately 1 meter in length (part number LEC-AAA101) and they provide the communication signals between the motor and the two amplifiers in the control module 118. The two armature/power cables 130, 132 are approximately 1 meter in length (part number LAC-AAA101) and they provide the power signals between the motor and the two amplifiers in the control module 118.

During resistance training, the vibrating motor 120*a-b* generates vibrations that cause the user's arms to tremble throughout the movement. In turn, the user is challenged to recruit their stabilizer muscles, as well as primary muscles, in order to steady the load. In some embodiments, an emergency power off switch 116 is used to instantly power off the vibrating motor 120*a-b*. Should the user desire abrupt cessation of the unit for any reason, pushing the Emergency Stop Device will bring the unit to an immediate STOP position.

Figure 8:
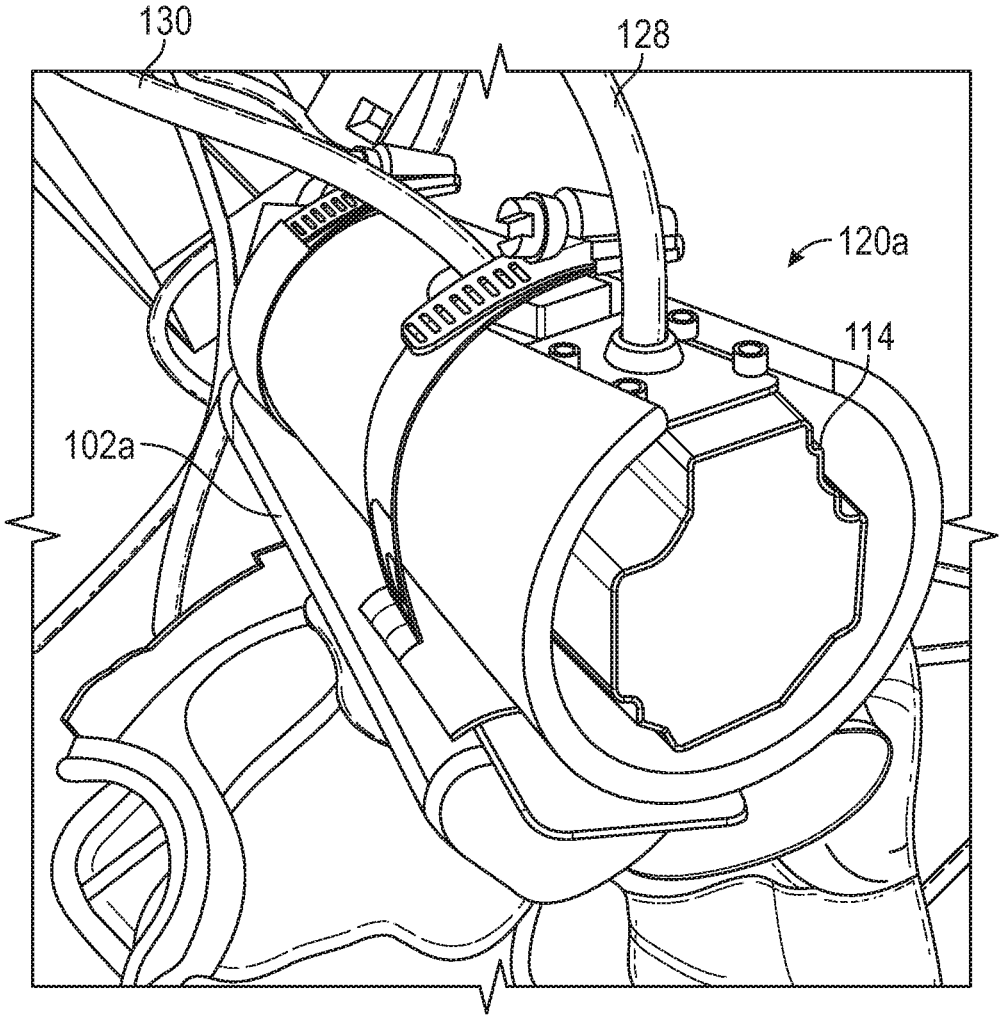
FIG. 8 illustrates a perspective view of an exemplary wrist strap with motor and power source, in accordance with an embodiment of the present disclosure.

In one exemplary operation shown in FIG. 8, device 100 comprises a pair of wrist wraps, each with their own built-in vibration motor 120*a*, 120*b* and power source 114. In one embodiment, the power source 114 and vibration motor operate without connection to any stationary control device, such that a user of the device 100 may move around freely, without attachment to any cables apart from the body. Cables 126, 128 connect to vibration motor 120*a*, 120*b* of wrist strap. Wrist straps can be used in gym environments and/or therapeutic settings as an effective tool to strengthen the stabilizer muscles of a fitness enthusiast or patient. More specifically, they can serve as a unique exercise equipment for athletes seeking to break a plateau or a patient rehabilitating an injury. Prior to exercise, the user securely fastens the wrap body 102*a-b* around each wrist, passing the thumbs through the thumb strap 112*a*, 112*b*. The flap 124 may also be used to compress the wrap body 102*a-b* against the forearm. The vibration motor may be enclosed in a housing, wherein the housing is attached to the body wrap with clamps, adhesives, straps or other attachment means as would be known to one of ordinary skill in the art.

Figure 9A:
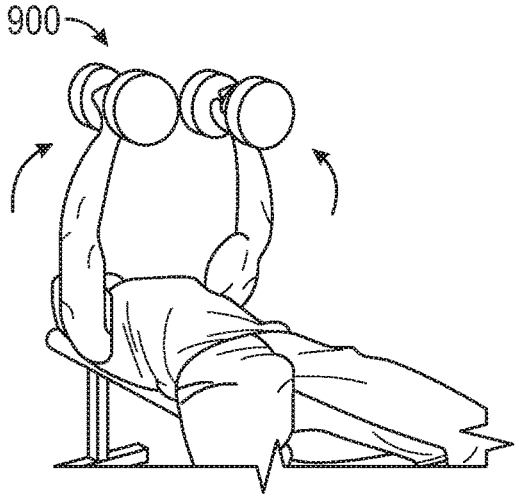
FIGS. 9A-9D illustrate perspective views of the hand and wrist wrapping device being donned for different resistance exercises, where
Figure 9B:
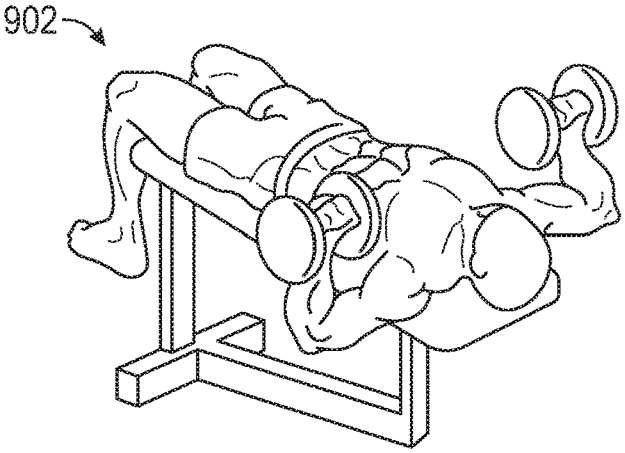
Figure 9C:
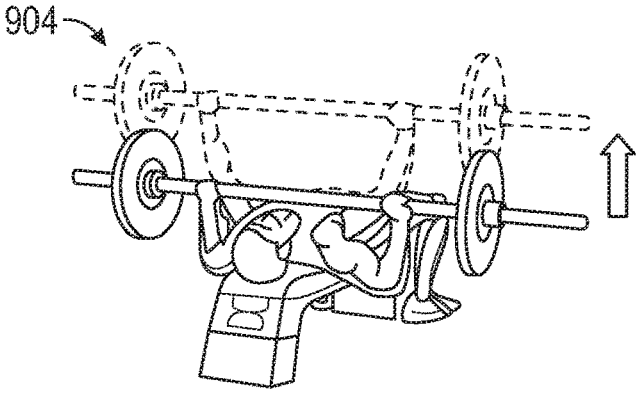
Figure 9D:
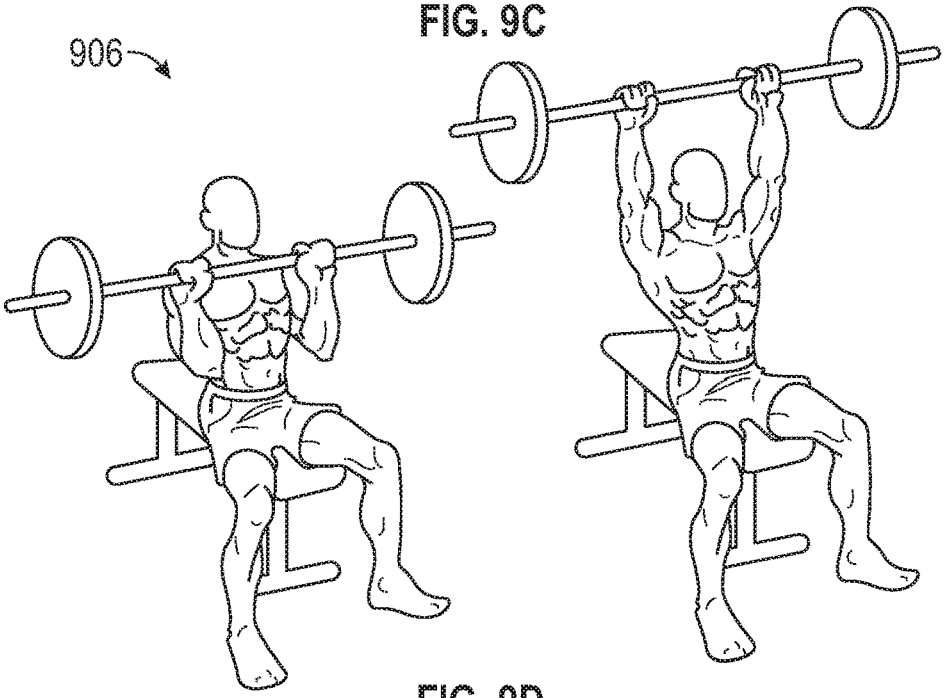

During training, the vibrating motor 120*a-b* generates vibrations that cause the user's arms to tremble throughout the movement. For example, the user may be a patient in rehab looking to fine tune their nervous system and restore/improve their ability to balance and reduce risk of falls (especially important in elderly). In turn, the user is challenged to use stabilizer and primary muscles in order to steady the load. During sporting activities, device 100 can challenge stabilizer muscles for a shot or throw, such that repeated use of the device 100 while training for sports results in Device 100 is operable with different types of resistance and "exercises and movements" to develop the stabilizer and primary muscles. For example, FIG. 9A shows a bench dumb bell resistance exercise 900, FIG. 9B shows an decline bench dumb bell resistance exercise 902, FIG. 9C shows a standard bench press resistance exercise 904, and FIG. 9D shows a sitting bench press resistance exercise 906. In each exercise, the primary and stabilizer muscles are being stimulated through use of device 100.

FIGS. 10 A-10F illustrate an eccentric rotating mass vibration motor assembly 250 and components thereof. FIG. 10A illustrates the eccentric rotating mass vibration motor assembly 250. FIG. 10A shows a standard motor 200, which in one embodiment may be a standard RS550 motor 200. Standard motor 200 is attached to an eccentric mass 204 by an eccentric mount 202. With regard to the relative dimensions of the standard motor 200, in one embodiment, the shaft has a relative length of 3.845 and the motor casing has a relative length of 2.615. The eccentric has a relative length of 2.795, including the motor bearing. Sizes of the components of eccentric rotating mass vibration motor assembly 250 are to scale as shown in the drawings. In one embodiment, the weight of standard motor 200 is 352 grams and the weight of the eccentric is 227 grams. Thus, in this embodiment, the ratio of weight between the standard motor to eccentric is approximately 3 to 2. The rotational speed for standard motor 200 may range from 110 rpm to 3,000 revolutions per minute (RPM). The force applied to the arm just below the wrist, horizontal to arm length axis may range from 0.125 g to 10 g.

FIG. 10B shows an exploded view of the eccentric rotating mass vibration motor assembly 250. Electrical connections 206 provide power to standard motor 200 of eccentric rotating mass vibration motor assembly 250. Motor bearing 216 encompasses motor shaft 214. Eccentric mount 202 attaches eccentric mass 204 to standard motor 200 and eccentric mounting screws 208 attach eccentric mass 204 to eccentric mount 202.

FIG. 10C shows a cross sectional view of the eccentric mount 202. FIG. Eccentric mount 202 is shown with a c-bore for a M5X 07.-25 MM cap screw. In some embodiments eccentric mount 202 may have eccentric offset holes 212. A drill and tap through 220 is shown in FIG. 10C. Eccentric mount 202 may be comprised of mild steel.

FIG. 10D shows a side view of the eccentric mount 202. Eccentric mount 202 includes a shaft clamping screw 218. In one embodiment, eccentric mount 202 may be comprised of mild steel. FIG. 10E shows a side view of the eccentric mass 204. In one embodiment, eccentric mass 204 includes two c-bores 210. FIG. 10F shows a front view of the eccentric mass 204, including c-bores 210. All components of the eccentric rotating mass vibration motor assembly 250 may fit within a housing, which may be a cylindrical tube comprised of Polyvinylchloride (PVC) or may be a portion of fabric containing plastic portions to hold the motor assembly in place, as would be known to one of ordinary skill in the art.

As the user becomes accustomed to training with device 100, the user undergoes physiological changes that allow them to accommodate for the vibratory stimulus. Depending on the strength of the user, a varying degree of vibration intensity may be required before the user is forced to steady the weight. For example, an individual with large stature may be stronger than an individual with small stature. In turn, the stronger individual may require a greater intensity of vibration before they are challenged to steady the weight.

As a result of the vibrations, the user experiences neural adaptations and enhanced primary and stabilizer muscle activation. These adaptations allow the body to move a given load with greater efficiency (less effort). For this reason, individuals are likely to experience an increase in their one repetition maximum upon discontinuation of the device 100. Thus, as the user becomes accustomed to training with the device 100, the user undergoes physiological changes that allow them to accommodate for the vibratory stimulus. In particular, an individual will experience neural adaptations and enhanced primary and stabilizer muscle activation. These adaptations enable the body to move a given load with greater efficiency and less effort. For this reason, subjects experience an increase in muscular strength and endurance. Alternative vibration motors, including but not limited to, linear actuator motors are contemplated within the present disclosure as providing the necessary force to generate muscle stimulation.

Further, device 100 may or may not work in conjunction with a computer or application, such as a cell phone application. The users may or may not be able to choose from a selection of workout programs or options that vary in intensity and level of vibration (similar to programmed settings on a treadmill hills, valleys, etc.). Users may be able to access programs or options through an electronic device, such as a computer or cell phone application.

Since many modifications, variations, and changes in detail can be made to the described preferred embodiments of the disclosure, it is intended that all matters in the foregoing description and shown in the accompanying drawings be interpreted as illustrative and not in a limiting sense. Thus, the scope of the disclosure should be determined by the appended claims and their legal equivalence.

What I claim is:

1. A muscle stimulation device, comprising:

at least one resilient wrap body sized and shaped to superimpose at least one wrist and knuckles, the wrap body defined by a fabric material having an upper surface, a lower surface opposing the upper surface, the upper and lower surfaces encapsulating a resilient wrap body cavity with a padded insert disposed therein, the wrap body further being defined by an upper end and a lower end opposing the upper end, the wrap body being sized and dimensioned to slidably receive a forearm, wrist, and knuckle;

at least one resilient thumb strap directly coupled to the upper end of the wrap body, the thumb strap forming a loop, the thumb strap being sized and dimensioned to receive a thumb;

a vibrating motor disposed against the wrap body, the vibrating motor vibrating at variable vibratory intensities, whereby the vibrating motor stimulates a plurality of stabilizer muscles near hands, shoulders, scapula, and shoulders/scapula;

a switching mechanism regulating a vibratory intensity of the vibrating motor;

a power source powering the vibrating motor;

an emergency power off switch for instantly powering off the vibrating motor; and a control module regulating the vibrating motor and the switching mechanism.

2. The device of claim 1, wherein the padded insert comprises a deformably resilient material.

3. The device of claim 1, wherein the wrap body further comprises a flap, including the upper surface of the wrap body, operably configured to have a first position along a flap translation path encapsulating the resilient wrap body cavity and a second position along the flap translation path defining a resilient wrap body opening spatially coupled to the resilient wrap body cavity to enable removal and entry of the padded insert.

4. The device of claim 3, wherein left and right strap fasteners, respectively, are of a hook-and-loop configuration.

5. The device of claim 1, wherein the wrap body further comprises a wrapped position along a hand wrapping path with the wrap body encapsulating a forearm and hand, the thumb straps wrapped around the thumbs, and the padded insert aligned with the knuckles.

6. The device of claim 1, wherein the switching mechanism comprises a dial.

7. The device of claim 1, wherein the control module comprises two sets of cables to control intensity and power of motors, and an armature/power connector.

* * * * *